US006027208A

United States Patent [19]

Amano

[11] Patent Number: 6,027,208

[45] Date of Patent: Feb. 22, 2000

[54] INK JET PRINTHEAD WITH PASSAGE FORMING PANEL AND VIBRATION PLATE

[75] Inventor: Toshio Amano, Kyoto, Japan

[73] Assignee: Rohm Co. Ltd., Kyoto, Japan

[21] Appl. No.: 08/722,494

[22] Filed: Sep. 27, 1996

[30] Foreign Application Priority Data

| | | | |
|---|---|---|---|
| Sep. 29, 1995 | [JP] | Japan | 7-253109 |
| Oct. 16, 1995 | [JP] | Japan | 7-267288 |
| Oct. 31, 1995 | [JP] | Japan | 7-283088 |

[51] Int. Cl.[7] ..... B41J 2/045

[52] U.S. Cl. ..... 347/70; 347/9; 347/86

[58] Field of Search ..... 347/68–72, 66, 347/86, 87, 50, 59, 9

[56] References Cited

U.S. PATENT DOCUMENTS

| | | | |
|---|---|---|---|
| 4,605,939 | 8/1986 | Hubbard et al. | 347/71 |
| 4,907,018 | 3/1990 | Pinkerpell et al. | 347/87 |
| 5,119,115 | 6/1992 | Buat et al. | 347/86 |
| 5,245,361 | 9/1993 | Kashimura et al. | 347/87 |
| 5,534,903 | 7/1996 | Hayakawa et al. | 347/71 |
| 5,581,288 | 12/1996 | Shimizu et al. | 347/71 |

FOREIGN PATENT DOCUMENTS 5-254140 10/1993 Japan .

*Primary Examiner*—John Barlow
*Assistant Examiner*—C. Dickens
*Attorney, Agent, or Firm*—Michael D. Bednarek; Crowell & Moring LLP

[57] ABSTRACT

An ink jet printhead is provided which includes a head body. The head body includes a passage forming panel formed with a plurality of grooved ink passages each communicating with a discharge port, and a vibration plate laminated on the passage forming panel to face the ink passages. The vibration plate is provided with a plurality of ink inlet ports for introducing ink into the ink passages. Therefore, an ink cartridge may be connected from behind the head body.

17 Claims, 16 Drawing Sheets

INK JET PRINTHEAD WITH PASSAGE FORMING PANEL AND VIBRATION PLATE

BACKGROUND OF THE INVENTION

1. Field of the Invention

The present invention relates to an ink jet printhead which is used as an printing portion of a printer, facsimile machine, plotter or the like.

2. Description of the Prior Art

An ink jet printhead of the above-described type is disclosed in Japanese Patent Application Laid-open No. 5-254140 (particularly, FIG. 3 thereof) for example. For the convenience of description, the ink jet printhead disclosed in this document is illustrated in FIGS. 15 and 16 of the accompanying drawings.

As shown in FIG. 15, the prior art ink jet printhead has a rectangular head body 1*e* formed with ink inlet ports 8*e* at predetermined peripheral positions 19*a*–19*d* of the head body (four corners of the head body 1 in FIG. 15). These ink inlet ports 8*e* are connected to four common ink passages 50*e*, and these common ink passages 50*e* are connected to a plurality of individual ink passages 51*e* provided in radial arrangement. Further, the head body 1*e* has a front surface formed with a plurality of discharge ports 55*e* communicating with the corresponding discharge ports 55*e*.

The four ink inlet ports 8*e* are independent of each other. Therefore, if inks of different colors including yellow, magenta (red), cyan (blue) and black are supplied through the ink inlet ports 8*e*, it is possible to perform desired color printing.

As shown in FIG. 16 for example, the head body 1*e* comprises a passage forming panel 10*e* made of glass, and a vibration plate 11*e* laminated on the passage forming panel. The passage forming panel 10*e* has one surface formed with grooved ink passages 5*e* which includes the above-mentioned individual ink passages 51*e* and common ink passages 50*e*. Further, the vibration plate 11*e* has a rear surface provided with piezoelectric elements 13 by intervention of a conductor layer 12 which is made of ITO film (tin oxide film containing a small amount of additives or indium oxide film containing tin oxide) for example. When the vibration plate 11*e* is flexibly deformed in the direction of arrow N2 by application of a voltage to each of the piezoelectric elements 13, the volume of the corresponding ink passage 5*e* instantaneously decreases to discharge the inside ink of the ink passage 5*e* through the corresponding nozzle port 55*e* as an ink droplet.

With the prior art ink jet printhead, each of the grooved ink passages 5*e* is extended to an outer edge 19*a* (or 19*b*–19*d*) of the head body 1*e* to form an ink inlet port 8*e*. Therefore, the ink passage 5*e* tends to be long, consequently leading an increase of resistance against ink flow.

On the other hand, if air (foams) gets in the ink inside the ink passages 5*e*, it is necessary to connect e.g. a suction device to the nozzle ports 55*e* for discharging out the foams together with the ink inside the ink passages 5*e*. However, in the prior art ink jet printhead, since the ink passages 5*e* are long, the wasted amount of ink discharged with the foams becomes large. Further, as the ink passages 5*e* become longer, the operation of discharging the inside foams gets more difficult.

Moreover, ink need be supplied from around the head body 1*e* for introducing the ink into the ink inlet ports 8*e* which are open radially of the head body 1*e*, as indicated by arrows N in FIG. 15. Thus, the structure for connecting the ink passages 5*e* of the head body 1*e* to the surrounding ink supply paths becomes complicated, and difficulty arises in sealing. As a result, the resistance to ink flow may vary greatly from one passage to another (which causes uneven discharge of ink droplets), and ink leakage is likely to occur. Further, there is also the problem of a manufacturing cost increase.

SUMMARY OF THE INVENTION

It is, therefore, an object of the present invention to provide an ink jet printhead wherein each ink passage is shortened to facilitate removal of foams contained in the ink while reducing waste of ink attendant with the ink removal.

Another object of the present invention is to provide an ink jet printhead wherein the structure of the ink flow paths is simplified to reduce the manufacturing cost while enabling uniform formation of ink droplets.

A further object of the present invention is to provide an ink jet printhead wherein a head body can be mounted easily and reliably.

Still another object of the present invention is to provide an ink jet printhead which can be reduced in size.

According to a first aspect of the present invention, there is provided an ink jet printhead comprising a head body which includes a passage forming panel having one surface formed with a plurality of grooved ink passages each communicating with a discharge port, and a vibration plate laminated on said one surface of the passage forming panel to face the ink passages, wherein the vibration plate is provided with a plurality of ink inlet ports for introducing ink into the ink passages.

With the above design, the ink inlet ports are provided in the vibration plate which constitutes the head body. As opposed to the prior art, therefore, each ink passage of the head body need not be extended to the outer edge of the head body, so that the overall length of the ink passage from the ink inlet port of the vibration plate to the discharge port of the head body can be reduced. As a result, even if foams get in the ink passage, these foams can be easily expelled out of the ink passage through the discharge port, and the amount of ink discharged through the discharge port at the time of ink removal can be made smaller to reduce waste of ink.

Further, there is no need for arranging ink supply paths around the head body for supplying ink to the ink inlet ports of the head body. Therefore, the structure of the ink supply paths for supplying ink to the ink passages of the head body can be greatly simplified to realize a overall cost reduction in manufacturing the printhead while also providing an advantage in the prevention of ink leakage. Moreover, it is also possible to reduce irregularities of flow resistance with respect to the ink supply paths for enabling uniform discharge of ink droplets from the plural nozzle ports, thereby improving the quality of images formed by printing.

Preferably, the ink passages include a plurality of common ink passages communicating with the ink inlet ports, and a plurality of individual ink passages each having one end connected to a respective one of the common ink passages, wherein the other end of each ink passages is connected to a respective one of the discharge ports. Such a design is advantageous for color printing.

According to a preferred embodiment of the present invention, the ink jet printhead further comprises at least one ink cartridge having an ink outlet port which faces a corresponding one of the ink inlet ports in communication therewith. Due to such a design, the ink outlet port of the ink cartridge may be easily connected to the corresponding ink inlet port of the head body. Further, the distance between the ink outlet port and the ink inlet port can be easily shortened to reduce the length of the ink flow path from the ink outlet port of the ink cartridge to the nozzle port of the head body. Therefore, the amount of ink wasted at the time of removing the foams from the ink passages can be additionally reduced.

Preferably, the ink jet printhead may further comprise a front frame having ink supply ports each establishing mutual communication between the corresponding ink inlet port and the ink outlet port, and each of the ink supply ports is provided with a filter for ink filtration. According to this design, the ink supply from the ink cartridge to the ink inlet port can be performed via the ink supply port of the front frame. Further, ink filtration is provided by the filter at the time of ink supply. Therefore, clogging of the ink passage and the discharge port can be prevented.

Preferably, the front frame may be mounted to a case member which is capable of housing the ink cartridge therein, and tubular seals made of an elastic member are interposed between the front frame and the ink cartridge, the ink outlet port of the ink cartridge being held in communication with a corresponding one of the ink supply ports of the front frame via a corresponding one of the tubular seals. The tubular seals interposed between the front frame and the ink cartridge under pressure serves to prevent ink leakage. Further, since the ink cartridge is housed in the case member, the size of the ink jet printhead as a whole can be additionally reduced.

According to a second aspect of the present invention, there is provided an ink jet printhead further comprising a head body provided with a plurality of piezoelectric elements, a flexible cord for electrical connection to the plurality of piezoelectric elements, a driver IC connected to one end of the flexible cord for controlling the piezoelectric elements, and a case member having a front portion for supporting the head body, wherein a connecting portion between the flexible cord and the driver IC is provided on an outer surface portion of the case member.

With the above structure, since the connecting portion between the flexible cord and the driver IC is provided on an outer surface portion of the case member, there is no need to provide an excess space for arranging the connecting portion inside the case member or between the case member and the head body. Therefore, the printhead as a whole can be reduced in thickness and size, thus making it convenient to incorporate the printhead in a desired apparatus such as printer.

Further, since the end of the flexible cord may be arranged on the outer surface portion of the case member, the flexible cord need not be long. Thus, the length of the flexible cord can be reduced to realize a cost reduction. Further, due to the shortening of the flexible cord, a voltage drop along the flexible cord can be also reduced for advantageously increasing efficiency of voltage application to the piezoelectric elements.

Preferably, a gap is formed between the head body and the case member for taking out a part of the flexible cord onto said outer surface portion of the case member. According to such a design, even if the flexible cord is interposed between the head body and the case member, a part of the flexible cord can be readily taken out through the gap for positioning on the outer surface portion of the case member. Therefore, the flexible cord need not be extended along a circumventing path for locating the connecting portion between the flexible cord and the driver IC on the outer surface portion of the case member, so that the flexible cord may be additionally shortened.

Advantageously, the connecting portion between the flexible cord and the driver IC is arranged in a groove on the outer surface portion of the case member. By such a design, the projecting dimension of the connecting portion between the flexible cord and the driver IC from the outer surface portion of the case member may be reduced by an amount corresponding to the depth of the groove. Further, the connecting portion may also be made not to project from the outer surface portion of the case member. Therefore, it is possible to prevent the connecting portion between the flexible cord and the driver IC from becoming bulky on the outer surface portion of the case member. The arrangement of the connecting portion within the groove also facilitates positional setting of the connecting portion.

According to a preferred embodiment of the present invention, the driver IC is directly mounted on said one end of the flexible cord. Due to such a design, the connecting portion between the flexible cord and the driver IC can be greatly simplified in structure to facilitate its production while realizing an additional size reduction of the connecting portion.

Said one end of the flexible cord may be provided with terminals for connecting the driver IC to an external printhead control device. According to this design, the flexible cord itself may be utilized for conveniently connecting the driver IC to the external printhead control device. However, a wiring member provided with terminals for connection to the external printhead control device may be separately prepared and connected to said one end of the flexible cord.

Preferably, the ink jet printhead may further comprise a reinforcing plate of a hard material fixed to said one end of the flexible cord. With such a design, the reinforcing plate reinforces the soft flexible cord to prevent the connecting portion between the flexible cord and the driver IC from warping or bending. Therefore, the conducting connection between the flexible cord and the driver IC can be appropriately maintained.

Advantageously, the connecting portion between the flexible cord and the driver IC is coated with a hard resin. According to such a design, a simple means of coating with a hard resin provides a protection for the driver IC and its associated wiring portion, thereby preventing damage to the driver IC and occurrence of improper electrical connection. Thus, there is no need to separately provide a large-scale component for protecting the connecting portion between the flexible cord and the driver IC on the outer surface of the case member, thereby conveniently realizing a structure simplification and a size reduction of the printhead as a whole.

According to a third aspect of the present invention, there is provided an ink jet printhead comprising: a head body having plural discharge ports and plural ink passages communicating with the discharge ports, a case member having a front portion for mounting the head body, ink supply ports formed in the case member for enabling ink supply to the respective ink passages when the head body is mounted to the case member, a presser frame for pressing the head body against the front portion of the case member, and fixing means for fixing the presser frame to the case member.

With the structure described above, the head body may be mounted to the front portion of the case member simply by causing the presser frame to press the head body into contact with the front portion of the case member and fixing the presser frame to the case member. Therefore, there is no need for using an adhesive or the like for attaching the head body to the case member, thereby facilitating the assembling operation. Further, in the case of using an adhesive for mounting the head body to the case member, the ink passages of the head body may be clogged up by the adhesive if the amount of applied adhesive is excessively large or if the adhesive is applied at improper positions. However, such a problem will not occur in the case of using the presser frame.

Preferably, the case member has side surfaces formed with engaging portions, and the fixing means comprises engaging pawls provided on the presser frame for engagement with the engaging portions. By such a design, there is no need to use screws or the like for mounting the presser frame to the case member, thereby additionally increasing the efficiency of the assembling operation.

For performing an accurate assembling operation, the front portion of the case member is advantageously formed with a recess for positioning the head body relative to the case member when the head body is fitted.

Preferably, the head body is provided with ink inlet ports in facing relation to the ink supply ports of the case member for introducing ink into the ink passages, and each of the ink inlet ports and a corresponding one of the ink supply ports communicate with each other via an annular elastic seal provided around one of the ink inlet port and the ink supply port. According to this design, when the head body is mounted to the case member, the seal is compressed between these two elements for properly sealing the connection between the ink supply port of the case member and the ink inlet port of the head body, thereby preventing undue ink leakage.

According to a fourth embodiment of the present invention, there is provided a method of making an ink jet printhead by assembling a head body onto a front portion of a case member, the head body having plural discharge ports and plural ink passages communicating with the discharge ports, the front portion of the case member having ink supply ports for communicating with the ink passages of the head body, the method comprising the steps of: pressing the head body against the front portion of the case member with a presser frame; and fixing the presser frame to the case member while the head body is kept pressed by the presser frame.

Other objects, features and advantages of the present invention will become apparent from the following description of the embodiments given with reference to the accompanying drawings.

DETAILED DESCRIPTION OF THE PREFERRED EMBODIMENTS

Figure 1:
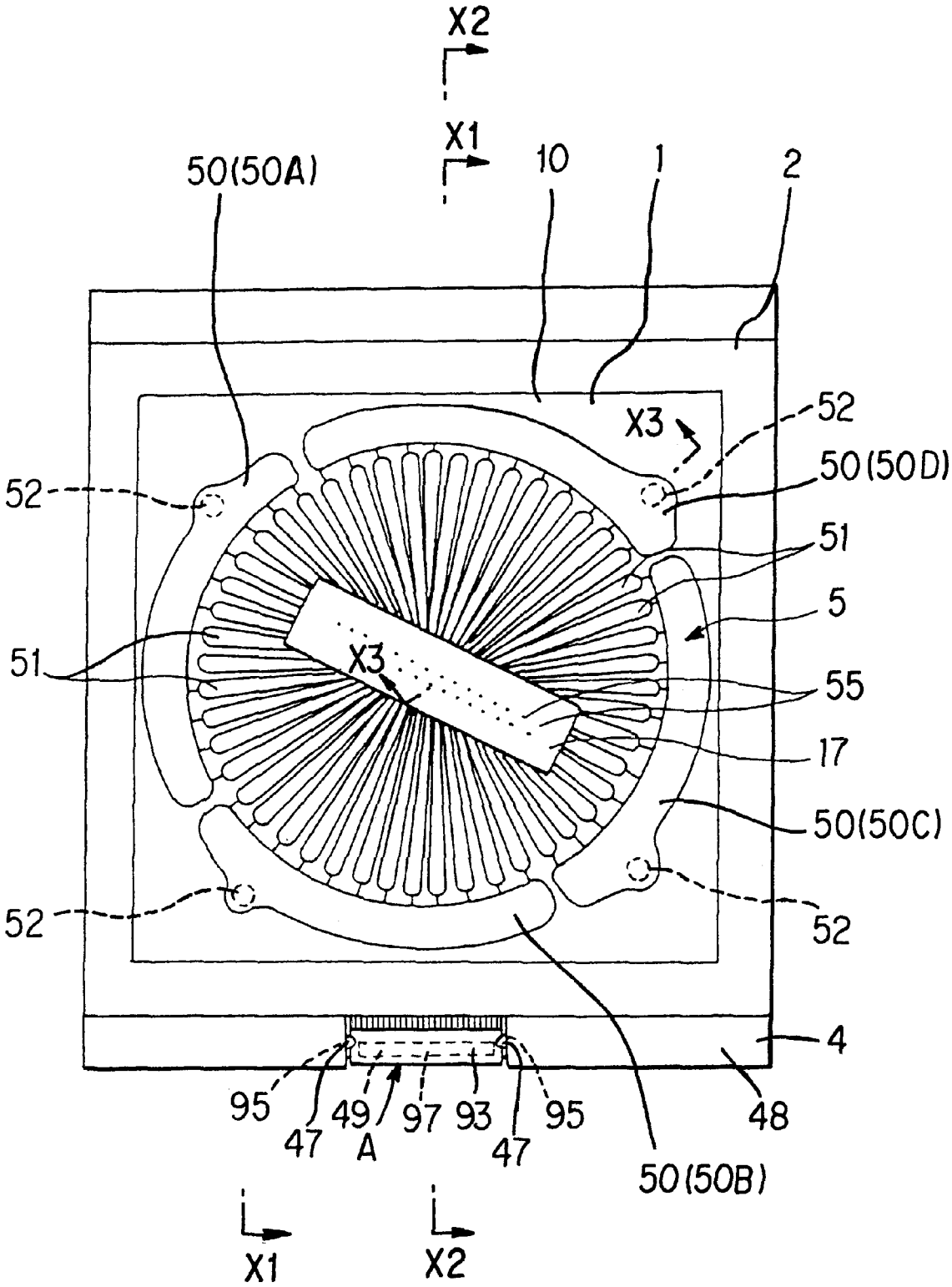
FIG. 1 is a front view showing an ink jet printhead according to a first embodiment of the present invention.

The preferred embodiments of the present invention will be described below with reference to the accompanying drawings. Of these drawings, FIGS. 1–8 show a first embodiment of the present invention, whereas FIGS. 10–14 represent a second embodiment. Further, FIG. 9 illustrates a partial modification of the first embodiment. In either one of these embodiments, an ink jet printhead is designed as a color ink jet printhead.

As shown in FIGS. 1–4, the ink jet printhead according to the first embodiment mainly comprises a head body 1, a front frame 2 serving as a support frame for the head body 1, a flexible cord 9 for electrical connection to the head body 1, a case member 4 for supporting the head body 1 via the front frame 2, and two ink cartridges 3 (3A, 3B) housed in the case member 4.

Figure 5:
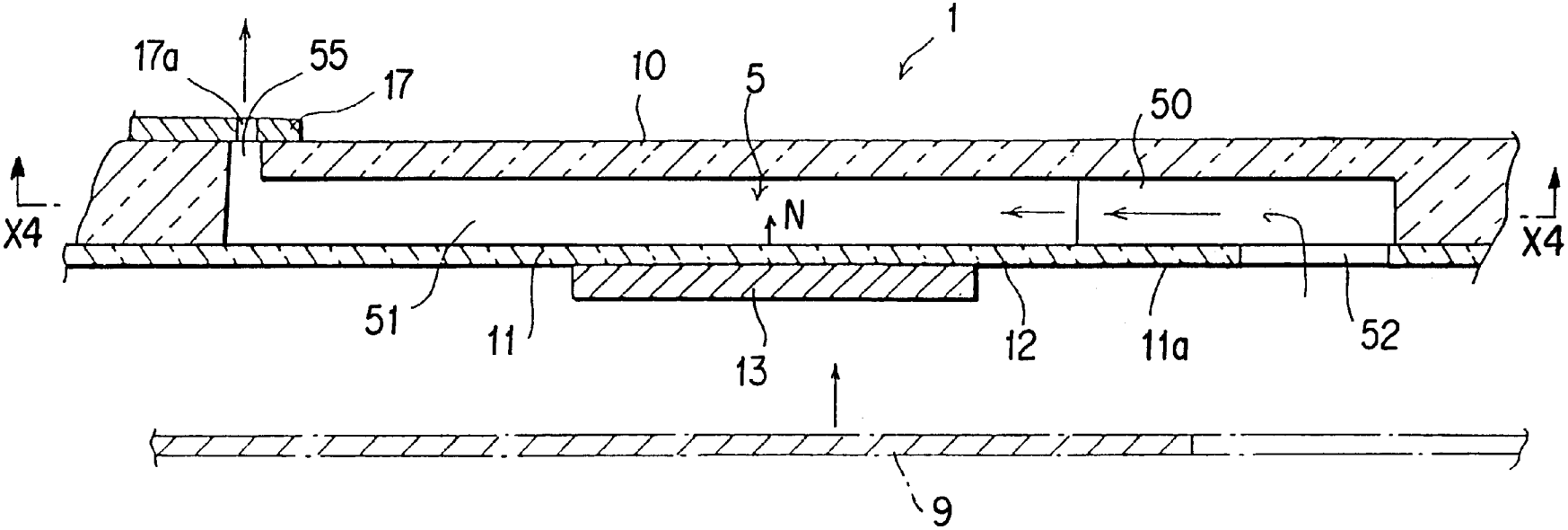
FIG. 5 is an enlarged fragmentary sectional view taken along lines X3—X3 in FIG. 1.
Figure 6:
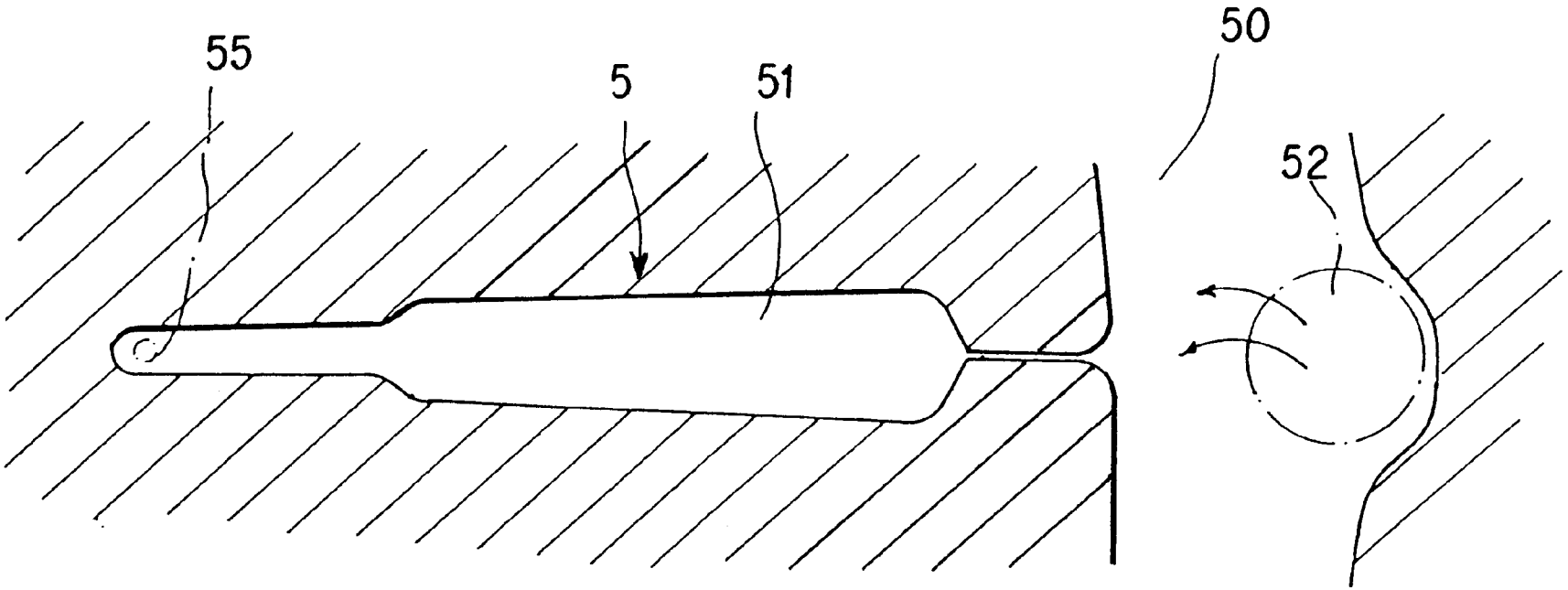
FIG. 6 is an enlarged fragmentary sectional view taken along lines X4—X4 in FIG. 5.

As shown in FIG. 5, the head body 1 includes a passage forming panel 10 and a vibration plate 11 provided with piezoelectric elements 13.

The passage forming panel 10 is made of a glass plate for example and formed, on its one side (rear side), with a plurality of grooved ink passages 5. These ink passages 5 include four arcuate common ink passages 50 (50A–50D) of a predetermined width, and a large number of individual ink passages 51 communicating with the respective common ink passages 50A–50D. The individual ink passages 51 are arranged radially in a circle or ellipsoid within the head body of a small size, thereby realizing a high space efficiency.

The four common ink passages 50A–50D correspond to inks of four colors including yellow, magenta (red), cyan (blue) and black, respectively, for color printing. However, since color printing is possible with three colors other than black, it suffices to provide three common ink passages. Further, in case where color printing is not required, all of the common ink passages may be loaded with black ink for example.

The front surface of the passage forming panel 10 is formed with a plurality of discharge ports 55 (FIG. 5) extending transversely of the individual ink passages 51. A total of sixty such discharge ports 55 are arranged in two rows for example for communication with the respective individual ink passages 51. Therefore, the ink of each of the four colors is discharged through fifteen discharge ports 55. A metal nozzle plate 17 having penetrating nozzle ports 17*a* in communication with the discharge ports 55 is fixedly attached to the front surface of the passage forming panel 10. The nozzle plate 17 is provided to allow for dimensional errors with respect to the position and diameter of the respective discharge ports 55.

The vibration plate 11 of the head body 1 is laminated on the rear surface of the passage forming panel 10 and fixed thereto by an adhesive for example. With such a structure, the vibration plate 11 serves as a side wall for the grooved ink passages 5 for closure thereof. However, the vibration plate 11 is formed with a total of four penetrating ink inlet ports 52 (FIGS. 1 and 5). These ink inlet ports 52 communicate with the respective common ink passages 50A–50D as shown in FIG. 1 and are open at the rear surface 11*a* of the vibration plate 11 (namely, at the rear surface of the head body 1). The ink of each of the four colors is introduced into the corresponding common ink passages 5 of the head body 1 through a respective ink inlet port 52.

The vibration plate 11 may be made of a glass plate, a synthetic resin plate or a metal plate each having a small wall thickness to provide flexibility. The rear surface 11*a* of the vibration plate 11 is formed with a conductor layer of e.g. ITO film for mounting the piezoelectric elements 13. These piezoelectric elements 13 are provided at respective positions corresponding to the plurality of individual ink passages 51. Thus, unless dummy discharge ports are provided, the piezoelectric elements are equal in number to the individual ink passages and the discharge ports 55. The respective piezoelectric elements 13 and the conductor layer 12 are held in conducting connection with a wiring portion of the flexible cord 9. Upon application of a voltage to each piezoelectric element 13, the vibration plate 11 deflects in the direction of arrow N. As a result, the pressure of the corresponding individual ink passage 51 rises for causing the inside ink to discharge outwardly as an ink droplet through the corresponding discharge port 55 and the nozzle port 17*a* of the nozzle plate 17 in communication therewith.

Figure 2:
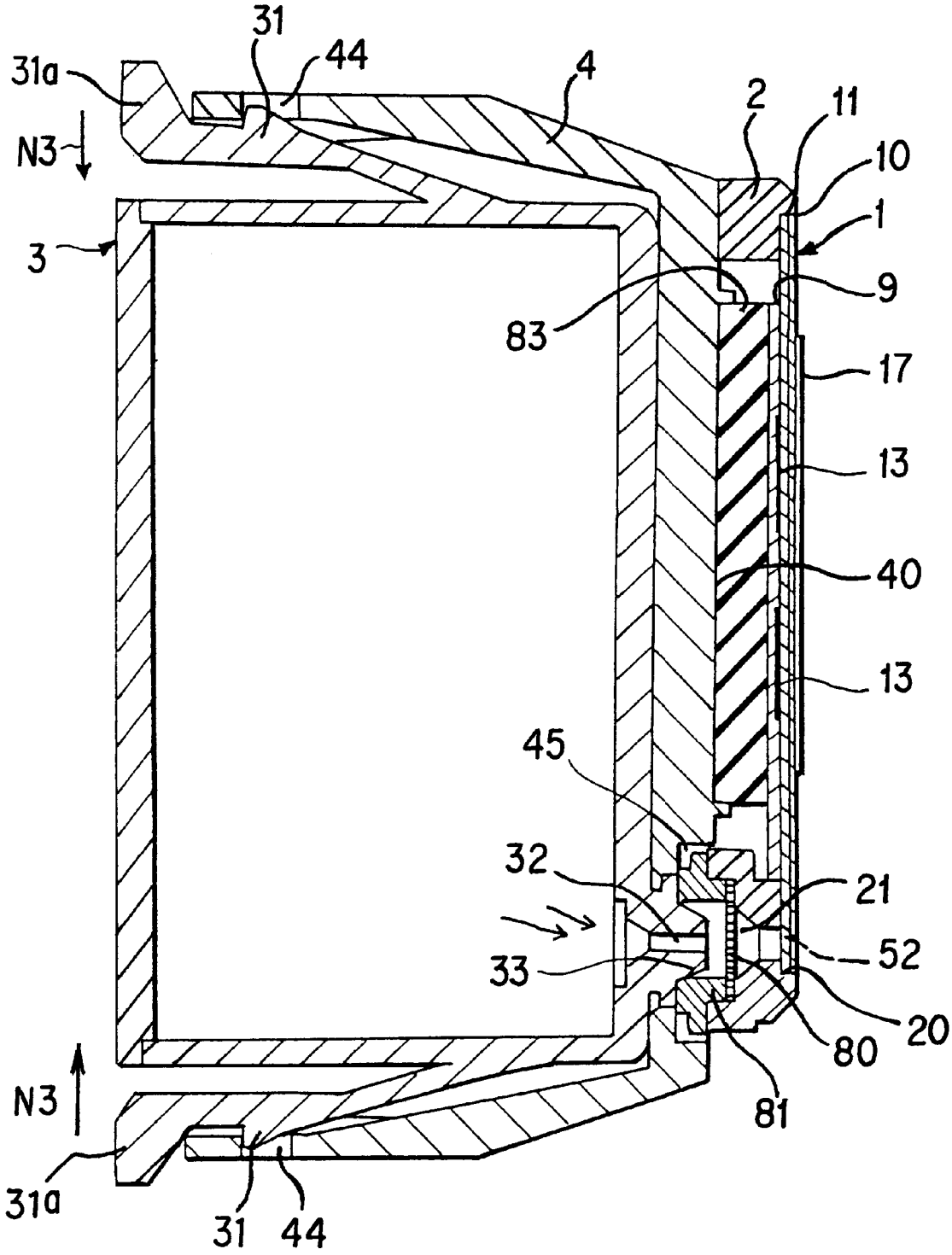
FIG. 2 is an enlarged sectional view taken along lines X1—X1 in FIG. 1.
Figure 4:
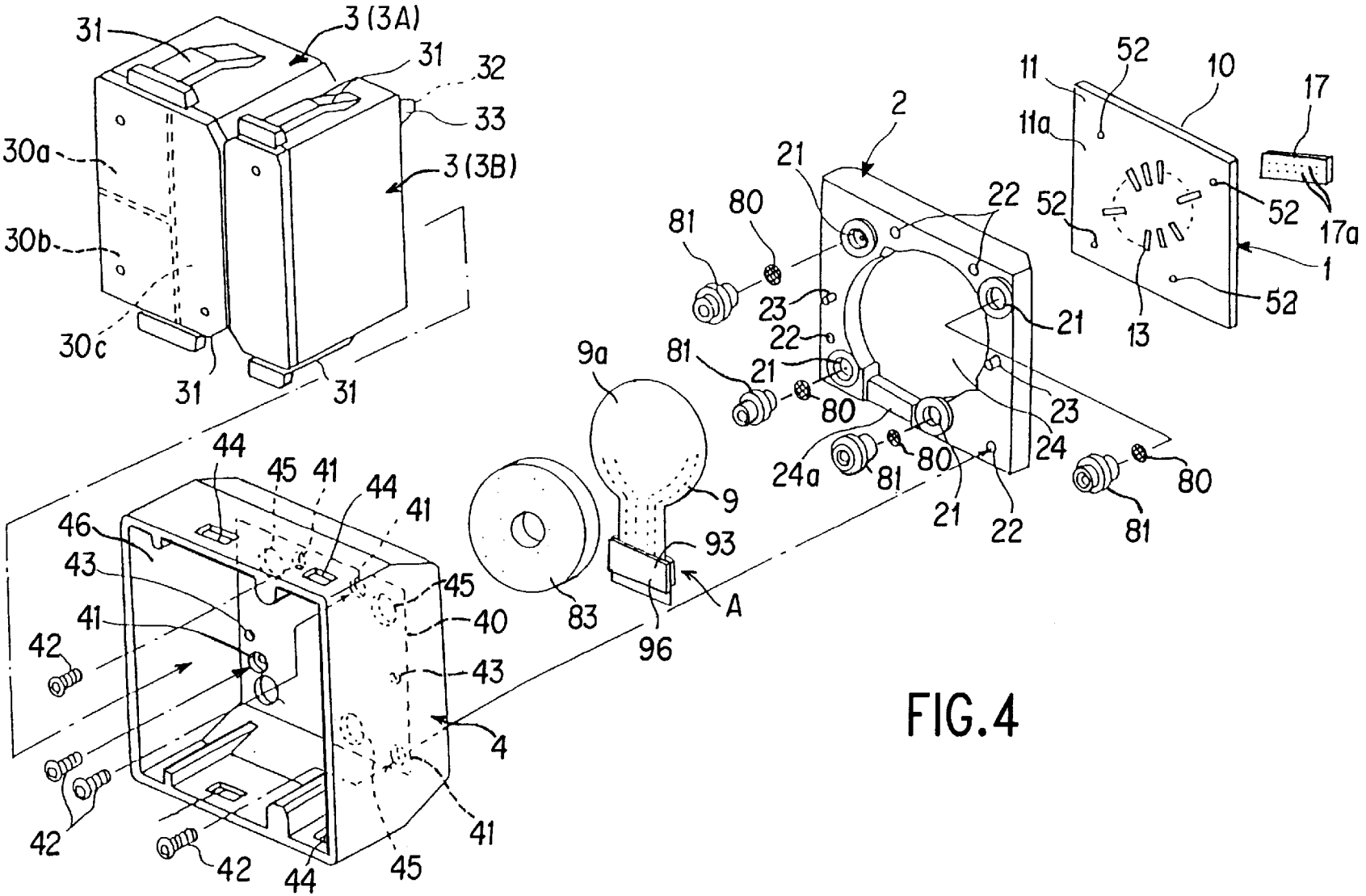
FIG. 4 is a perspective exploded view showing the same ink jet printhead.

As shown in FIG. 4, the front frame 2 has a central window opening 24. As shown in FIG. 2, the front wall of the front frame 2 is formed with a recess 20, and the head body 1 is fitted and adhesively fixed in the recess 20. The front frame 2 is mounted to the front wall 40 of the case member 4, whereby the head body 1 is indirectly supported by the case member 4.

For mounting the front frame 2 to the case member 4, the front wall 40 of the case member 4 is penetrated by screw insertion bores 41, whereas the rear wall of the front frame 2 is provided with threaded bores 22, as shown in FIG. 4. Suitable screws 42 are inserted through the screw insertion bores 41 of the case member 4 from behind for engagement with the threaded bores 22 of the front frame 2, thereby fixing the front frame 2 relative to the case member 4. Further, positioning pins 23 may be provided to project from the rear wall of the front wall 4 for insertion into positioning bores 43 of the front wall 40 of the case member 4, thereby improving positional precision of the front frame 2 relative to the case member 4.

As shown in FIGS. 2 and 4, the front frame 2 is provided with a total of four ink supply ports 21 for feeding ink to the respective ink inlet ports 52 of the head body 1. Each of the ink supply ports 21 is stepped to arrange therein a filter 80 for ink filtration. The filter 80 may be a discal mesh member having a minute mesh size for example.

A total of four tubular seals 81 are interposed between the rear wall of the front frame 2 and the front wall 40 of the case member 4. Each of these seals 81 is made of an elastic material such as rubber and has a flange. One end of the seal is inserted in the ink supply port 21 of the front frame 2, so that the filter 80 is positioned and fixed by the seal 81.

The case member 4 is in the form of a rectangular box for example. The case member 4 has a hind opening 46 for removably accommodating the two ink cartridges 3A, 3B. Specifically, each of the ink cartridges 3 has an upper wall and a lower wall each of which is formed with an elastic projection 31 for engagement with a hole 44 formed in each of the upper and lower walls of the case member 4 upon insertion of the cartridge 3 into the case member 4. The projection 31 may be disengaged from the hole 4 by pressing, with a finger, the outer end 31*a* of the projection 3 in the direction of arrow N3 in FIG. 2, thereby allowing the ink cartridge 3 to be taken out from the case member 4. As shown in FIG. 4, one cartridge 3A has three partitioned chambers 30*a*–30*c* for separately containing inks of three colors, e.g. yellow, cyan and magenta. The other ink cartridge 3B may be used for containing a black ink for example.

The front wall 40 of the case member 4 has four through-holes 45 each in facing relation to a respective ink supply port 21 of the front frame 2. Each of the through-holes 45 receives a projecting nozzle 33 formed on the front wall of a respective ink cartridge 3. The nozzle 33 comes into contact with the corresponding tubular seal 81 for preventing ink leakage. As shown in FIG. 2, the nozzle 33 of the cartridge 3 has an ink outlet port 32 in communication with the corresponding ink inlet port 52 of the head body 1 through the ink supply port 21 of the front frame 2, consequently allowing the ink of the cartridge 3 to be supplied into the respective ink passages 5 of the head body 1 through the ink outlet port 32.

Figure 7:
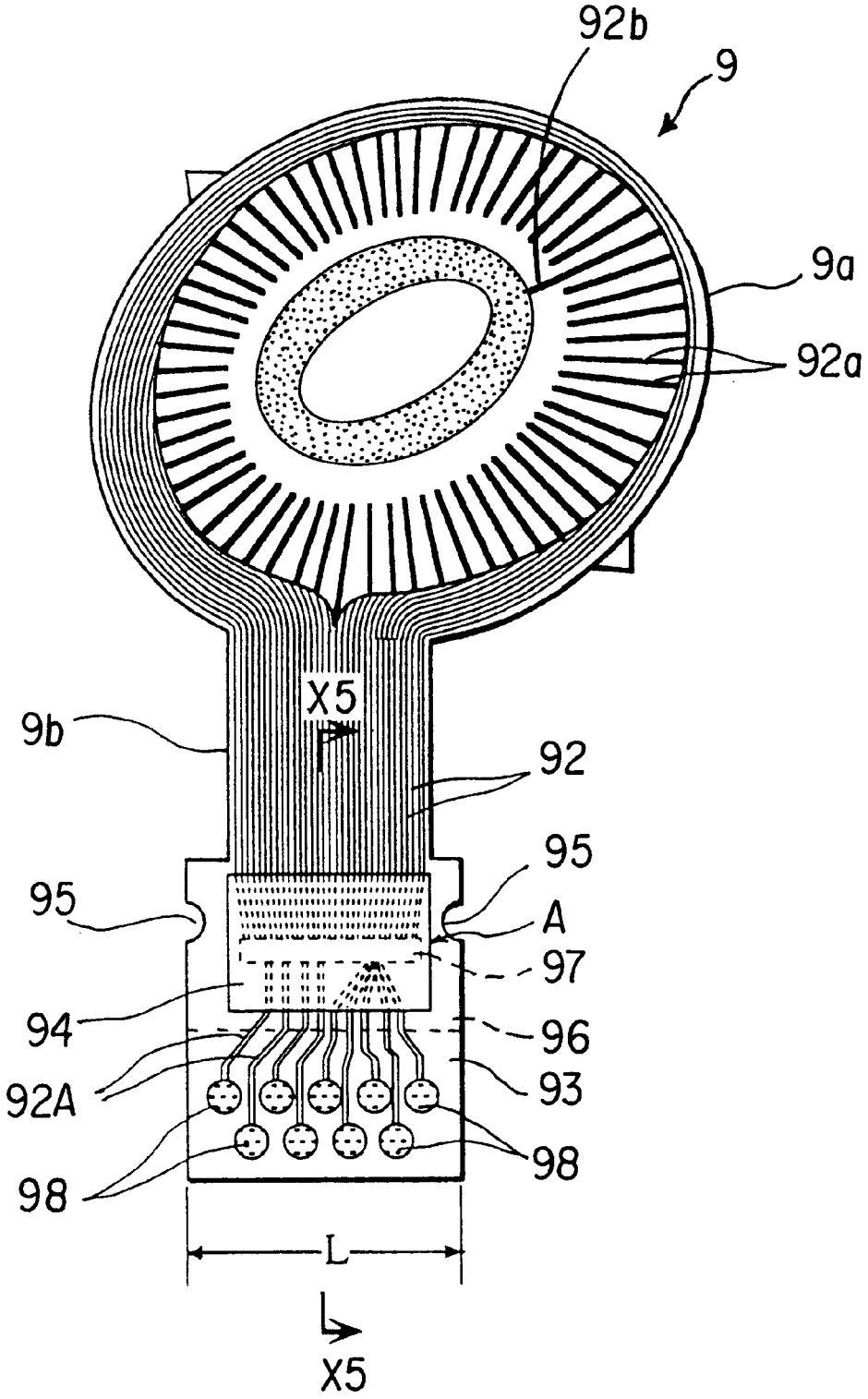
FIG. 7 is a front view showing a flexible cord incorporated in the same ink jet printhead.
Figure 8:
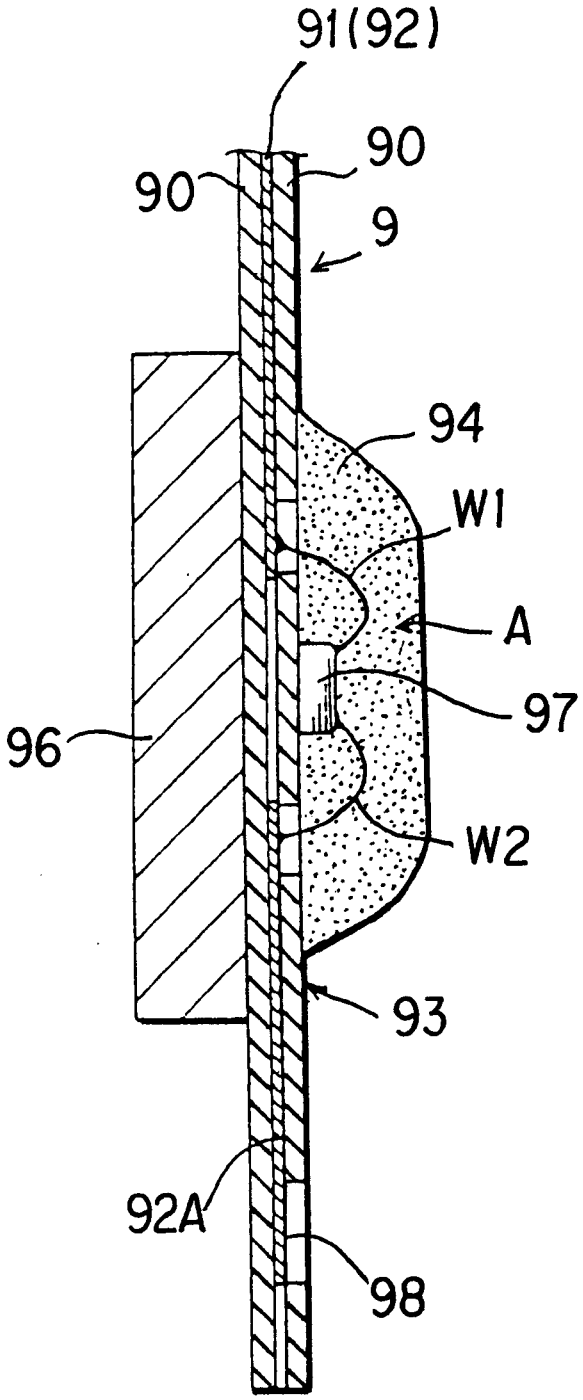
FIG. 8 is an enlarged fragmentary sectional view taken along lines X5—X5 in FIG. 7.
Figure 9:
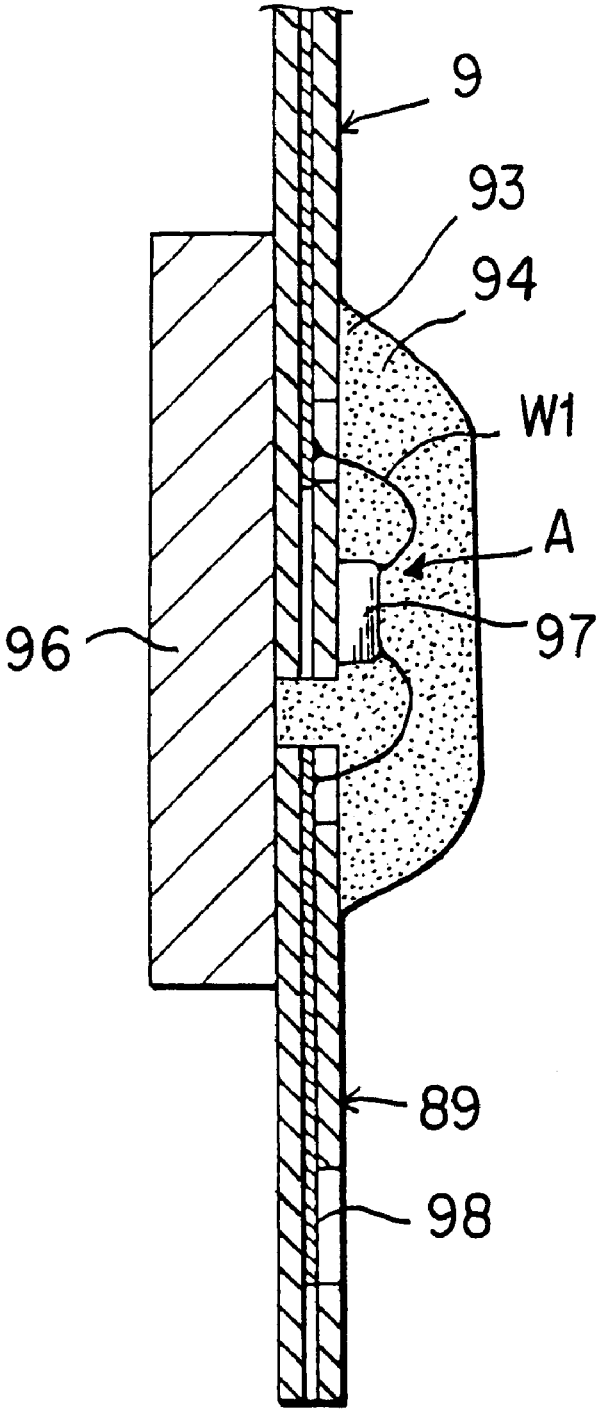
FIG. 9 is an enlarged fragmentary sectional view similar to FIG. 8 but showing a different flexible cord.
Figure 10:
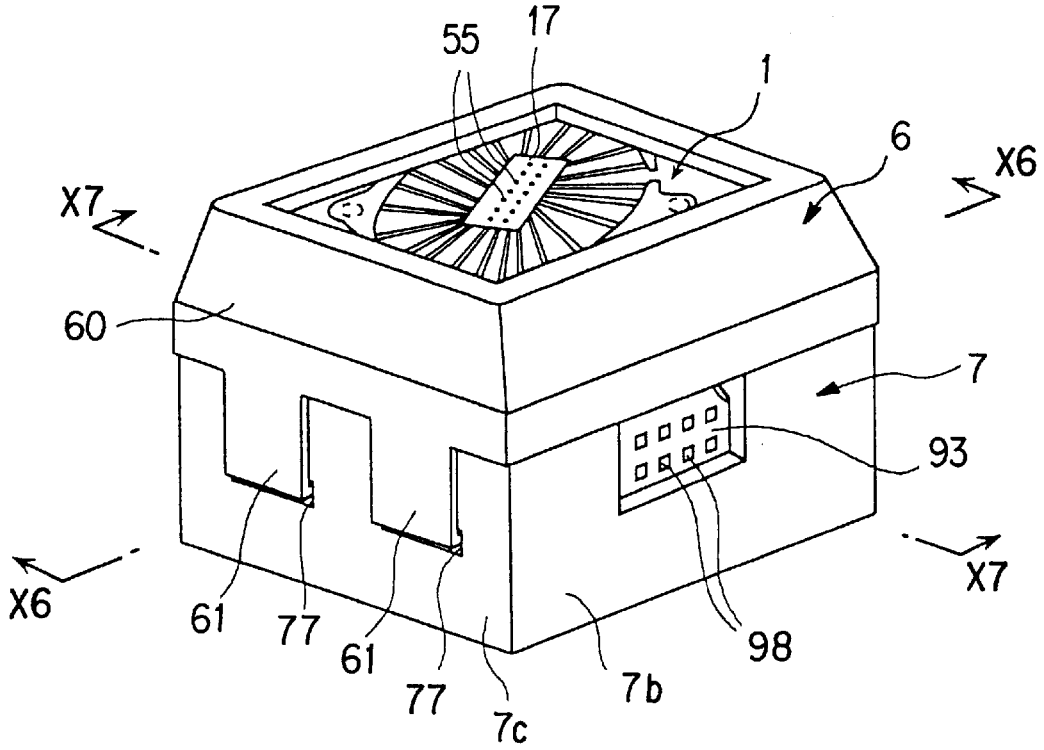
FIG. 10 is a front view showing an ink jet printhead according to a second embodiment of the present invention.

As shown in FIG. 8, the flexible cord 9 comprises two electrically non-conductive thin flexible films 90 between which is interposed an electrically conductive layer 91 for forming a connection-wiring pattern. As shown in FIG. 7, the flexible cord 9 has a band portion 9*b* and a circular enlarged portion 9*a* connected to the band portion 9*b*. The enlarged portion 9*a*, which is arranged behind the head body 1, has a multiplicity of connection terminals 92*a* disposed in radial arrangement for connection with the multiple piezoelectric elements 13 of the head body 1, and a single grounding terminal 92*b*. The band portion 9*b* is provided with a wiring pattern 92 connected to the above-described terminals 92*a*, 92*b*.

One end 93 of the band portion 9*b* of the flexible cord 9 has a wider width L than the other part of the band portion 9*b*. Attached to the rear surface of the widened end 93 is a reinforcing plate 96 having a width generally equal to the width L of the widened end. The reinforcing plate 96 may be made of a hard material such as glass-fiber-reinforced epoxy.

On the other hand, the front surface of the widened end 93 of the flexible cord 9 is provided with a connecting portion A for establishing connection between the flexible cord 9 and a driver IC 97 which drives and controls the piezoelectric elements 13. Specifically, the drive IC 97 is directly mounted on the front surface of the widened end 93 of the flexible cord 9, and the output terminals of the driver IC 97 are connected to the wiring pattern 92 (conductive layer 91) of the flexible cord 9 via wires W1.

Further, a plurality of terminals 98 are additionally provided on the front surface of the widened end 93 of the flexible cord 9. These terminals 98 are used for establishing connection to a printhead control device (not shown) such as CPU of the printer which incorporates the present printhead. The terminals 98 are supplied with drive voltage for driving the driver IC 97 as well as various control signals which include serial image data signals, clock signals, latch signals and strobe signals. A wiring pattern 92A constituting the terminals 98 is connected to the input terminals of the driver IC via wires W2.

The front surface of the widened end 93 of the flexible cord 9 is further provided with a resin coating layer 94 covering the driver IC 97 together with the wires W1, W2. The resin coating layer 94 may be made of a hard resin such as epoxy resin for protection of the driver IC 97 and the wires W1, W2.

The reinforcing plate 96 is arranged behind the driver IC 97 and the wires W1, W2. Therefore, the reinforcing plate 96 prevents the flexible cord 9 from flexibly deforming at a portion thereof where the driver IC 97 and the wires W1, W2, thus avoiding connection failure.

Figure 3:
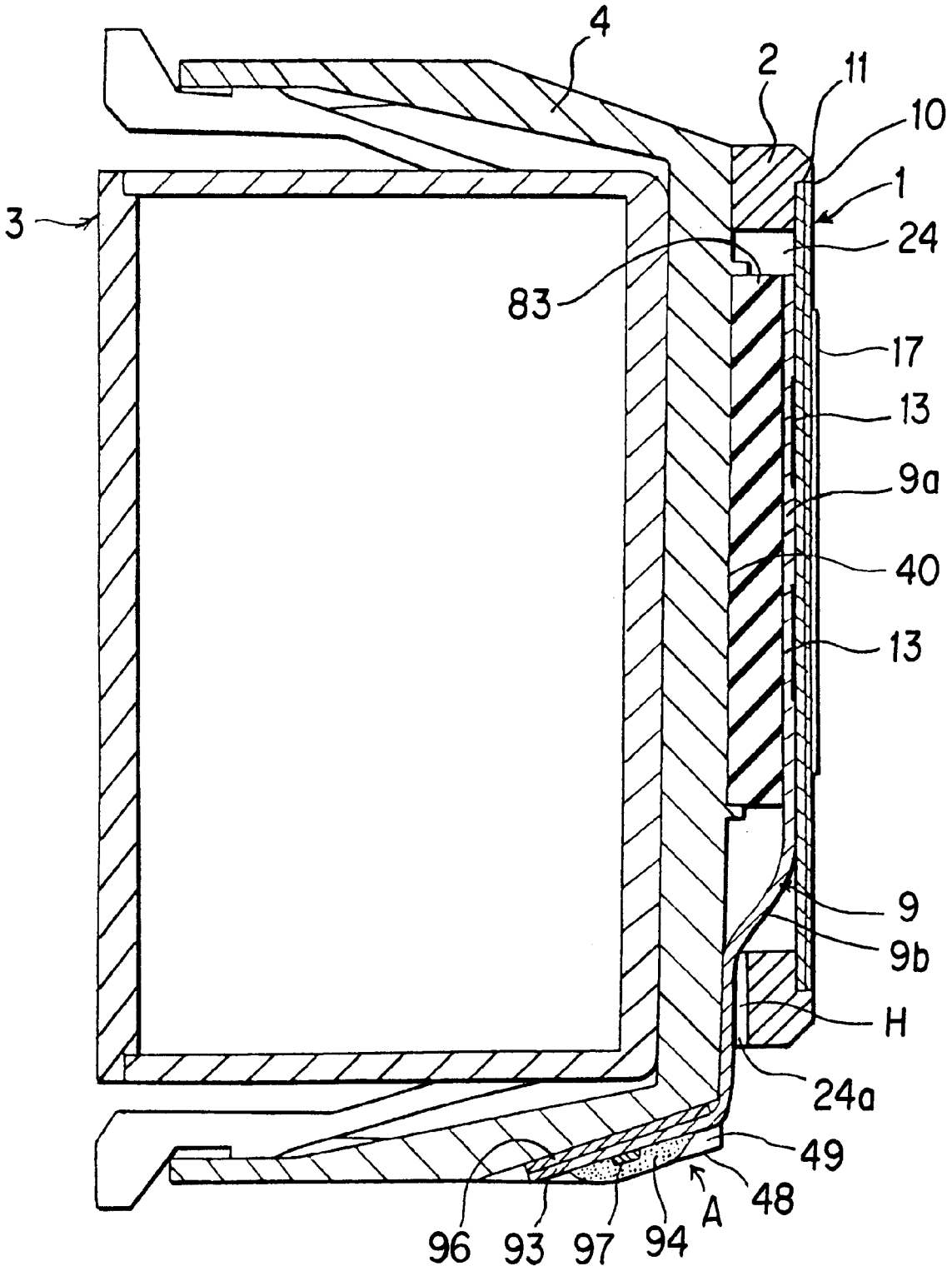
FIG. 3 is an enlarged sectional view taken along lines X2—X2 in FIG. 1.

As shown in FIG. 3, the enlarged portion 9*a* of the flexible cord 9 is arranged in the window opening 24 of the front frame 2 for mounting between the front wall 40 of the case member 4 and the head body 1. A soft cushion member 83 in the form of a pad presses the enlarged portion 9*a* against the piezoelectric elements 13 at the rear surface of the head body 1 under a suitable pressure.

On the other hand, the band portion 9*b* of the flexible cord 9 is led out of the printhead through a gap H between the front frame 2 and the case member 4. The gap H may be formed by providing a groove 24*a* on the rear surface of the front frame 2.

The widened end 93 of the flexible cord 9 led out of the printhead through the gap H as well as the connecting portion A for the driver IC 97 is arranged on an outer inclined surface portion 48 of the case member 4. Specifically, the reinforcing plate 96 adhesively attached to the widened end of the flexible cord 9 is fitted in a groove 49 of a predetermined width formed on the outer inclined surface portion 48 of the case member 4, and fixed therein by using an adhesive or a double-coated adhesive tape for example. Both side edges of the widened end 93 of the flexible cord 9 are formed with cutouts 95 of a suitable shape, e.g. semi-circle, as shown in FIG. 7. These cutouts 95 come into engagement with projections 47 on both side walls of the groove 49, as shown in FIG. 1. Thus, the widened end 93 of the flexible cord 9 can be accurately positioned and reliably fixed in place.

In operation of the ink jet printhead thus structured, the inks of four colors contained in the ink cartridges 3 (3A, 3B) flow out of the cartridges 3 through the respective ink outlet ports 32 and enter the ink supply ports 21 of the front frame 2 after passing through the tubular seals and the filters 80. Then, the inks flowing in the ink supply ports 21 pass through the ink inlet ports 52 of the vibration plate 11 of the head body 1 into the respective ink passages 5 of the head body 1, i.e., into the respective individual ink passages 51 by way of the four common ink passages 50. In this condition, if the pressure of selected individual ink passages 51 rise due to deflection of the vibration plate 11, ink droplets of predetermined colors are discharged out through the corresponding discharge ports 55 to make a color print. In actual use, the ink jet printhead is oriented so that the discharge ports 55 of the head body 1 are directed downward for efficiently and entirely consuming the inks of the ink cartridges 3.

With the above-described ink jet printhead, the ink flow paths extending from each ink outlet port 32 of the ink cartridges 3 to a respective ink inlet port 52 of the head body 1 is considerably shortened. Further, each ink inlet port 52 is connected directly to a respective common ink passage 50 of the head body 1, and the overall length of the respective ink passages 5 within the head body 1 is also shortened considerably.

Therefore, the length of the ink flow paths may be minimized or nearly minimized as required for restraining foams from remaining in the ink passages. Further, due to the shortening of the ink flow paths, it is possible to reduce the amount of ink required for filling the ink passages, so that the amount of ink wastefully discharged through the discharge ports 55 can be reduced when a suction device is connected to the surface of the nozzle plate 17 for sucking out the remaining ink together with foams from the ink passages through the discharge ports 55.

Further, since the front frame 2 for supporting the head body 1 need only be spaced from the ink cartridges 3 by an amount which is enough for interposing the tubular seals 81, the front frame 2 and the ink cartridges 3 may be arranged considerably close to each other. Therefore, the printhead as whole may be reduced in size while increasing the ink capacity of the cartridge 3. Moreover, the tubular seals 81, which establish connection between the ink discharge ports 32 of the cartridges 3 and the ink supply ports 21 of the front frame 2, do not require a large space and a complicated assembling operation, thereby preventing objectionable ink leakage while realizing facilitation of the assembling operation.

In the above-described ink jet printhead, the connecting portion A between the widened end 93 of the flexible cord 93 and the driver IC 97 are arranged on the outer inclined surface 48 of the case member 4. Therefore, there is no need to provide a space for connecting the flexible cord 9 to the driver IC 97 inside the case member 4 or between the case member 4 and the head body 1, thereby realizing an additional size reduction of the ink jet printhead as a whole. In particular, since the widened end 93 of the flexible cord 9 is fitted in the groove 49 of the case member 4, it is possible to suitably prevent the connecting portion A from projecting outwardly from the outer inclined surface of the case member 4 to a large extent. Thus, the printhead as a whole may be reduced in size without being bulky.

Further, since the widened end 93 of the flexible cord 9 is led out of the printhead through the gap H between the head body 1 and the case member 4, the widened end 93 of the flexible cord 9 may be arranged on the outer inclined surface 48 of the case member 4 with a minimum distance. Therefore, the overall length of the flexible cord 9 may be reduced. It should be noted that the flexible cord 9 serves to apply voltage to the piezoelectric elements 13 and therefore should desirably be as short as possible to reduce a voltage drop.

In the above-described embodiment, the terminals 98 for connecting the driver IC 97 to an external printhead control device are provided on the widened end 93 of the flexible cord 9. However, as shown in FIG. 9, a separate wiring member 89 (e.g. a separate flexible cord) may be provided adjacent to the widened end 93 of the flexible cord 9 carrying the driver IC 97, and the terminals 98 may be provided on this wiring member 89.

Further, in the above embodiment, the driver IC 97 is mounted on the surface of the widened end 93 of the flexible cord 9. However, the driver IC 97 may be mounted on the reinforcing plate 96 for example.

Further, in the above embodiment, the connecting portion A between the widened end 93 and the flexible cord 9 and the driver IC 97 is fitted in the groove 49 formed on the outer inclined surface 48 of the case member 4. However, the groove 49 and the outer inclined surface 48 may be omitted, and the connecting portion A may be arranged on a non-inclined lower surface of the case member 4.

Next, the second embodiment of the present invention will be described with reference to FIGS. 10–14.

Figure 13:
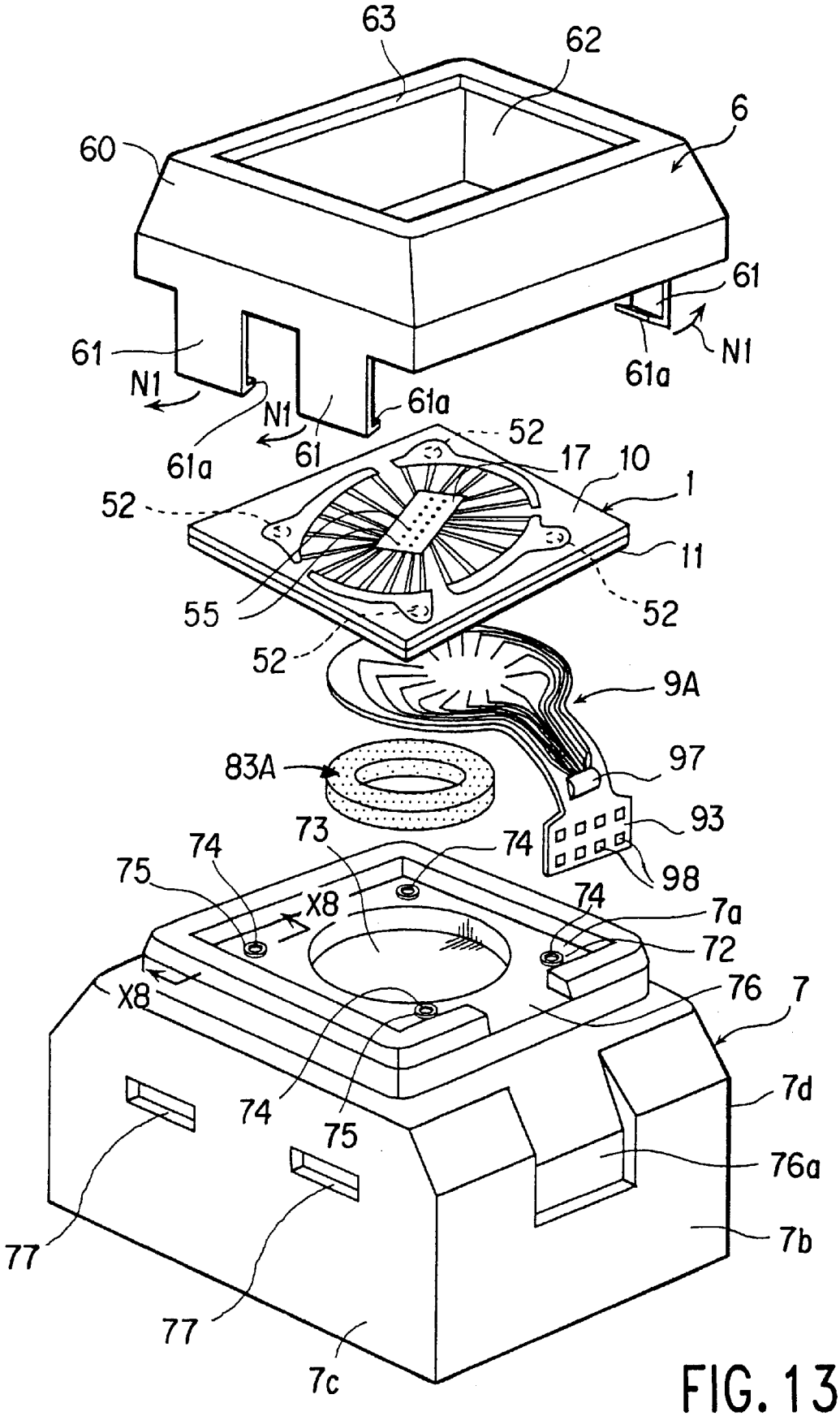
FIG. 13 is a perspective exploded view showing the ink jet printhead of the second embodiment.

As shown in FIG. 13, the ink jet printhead according to the second embodiment mainly comprises a head body 1, case member 7, a flexible cord 9A, a cushion member 83A, and a presser frame 6. The head body 1 and the flexible cord 9A are basically identical to those of the first embodiment, so that the description of these elements is omitted.

The cushion member 83A serves to press the flexible cord 9A against the head body 1 with a suitable pressure. The cushion member 9A is made of a relatively soft elastic material such as sponge rubber and formed into a hollow or solid discal shape.

Figure 11:
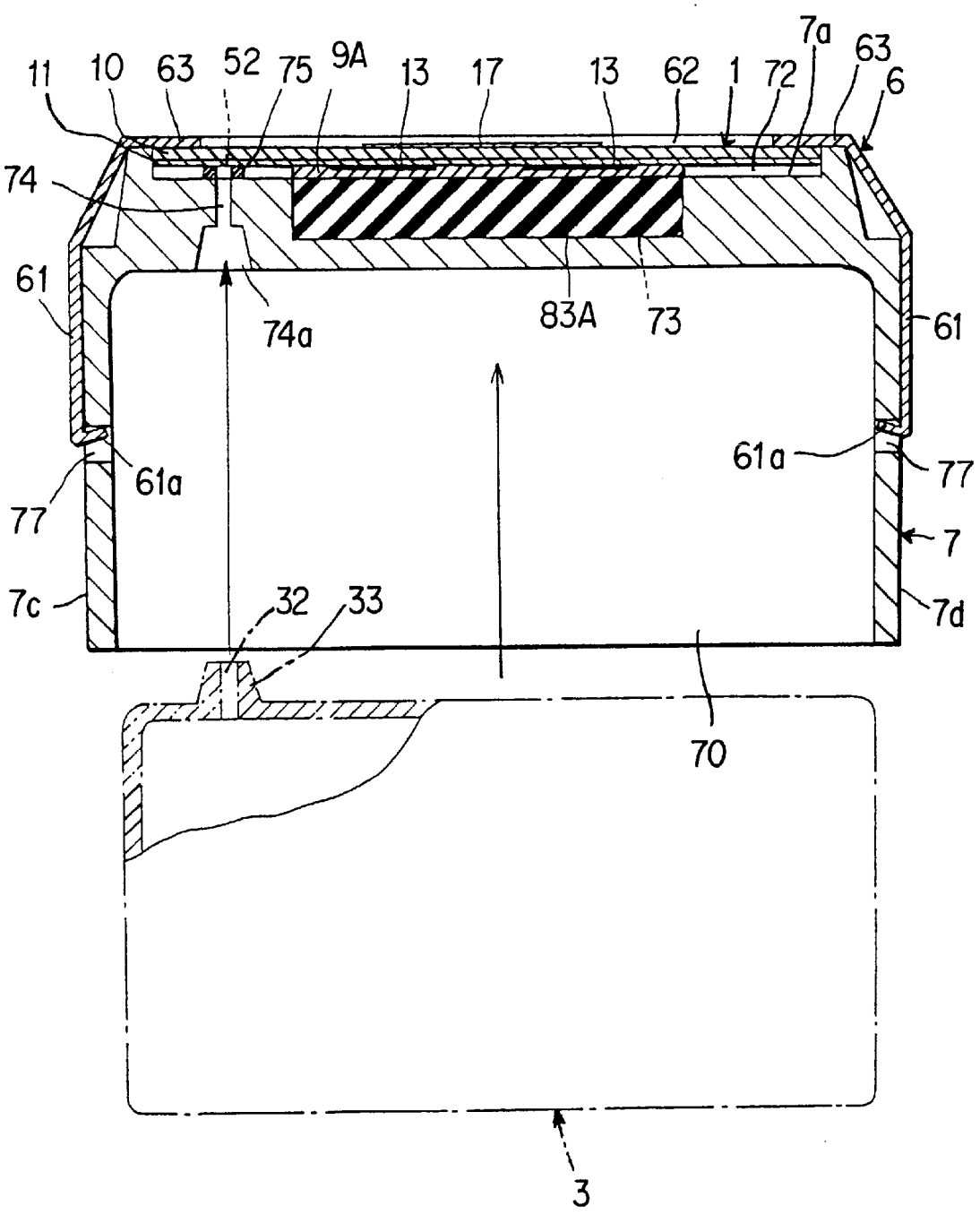
FIG. 11 is an enlarged sectional view taken along lines X6—X6 in FIG. 10.

The case member 7 is made of synthetic resin and has an opening 70 which is directly rearwardly (downwardly in FIG. 11). An cartridge 3 can be removably introduced into the case member 7 through the opening 70. For the convenience of description, it is assumed in this embodiment that only a single ink cartridge is provided. In the case of performing a color printing operation, the ink cartridge 3 supplies inks of three or four colors from partitioned chambers formed inside.

As shown in FIG. 13, the case member 7 has a front wall 7*a* formed with a first recess 72 for fitting and positioning the head body 1. The depth of the first recess 72 is generally equal to the thickness of the head body 1. Within the first recess 72, a second 73 is additionally formed for fitting the cushion member 83A. Further, the front wall 7*a* of the case member 7 is provided with a total of four ink supply passages 74. The ink supply passages 74 serve to introduce ink to the ink inlet ports 52 of the head body 1 and are positioned in corresponding relation to the ink inlet ports 52.

As shown in FIG. 11, each of the ink supply ports 74 communicates with a taper bore portion 74*a* in which a nozzle 33 of the ink cartridge 3 can be fitted, the nozzle having an ink outlet port 32. Therefore, when the ink cartridge 3 is housed inside the case member 7, the ink from the ink cartridge 3 is made to flow out through the ink supply port 74. In use, the nozzle ports 55 of the head body 1 should be preferably directed downward (i.e., the printhead illustrated in each of the figures is held upside down) for allowing the entire ink of the cartridge 3 to flow out through the ink supply port 74.

Figure 14:
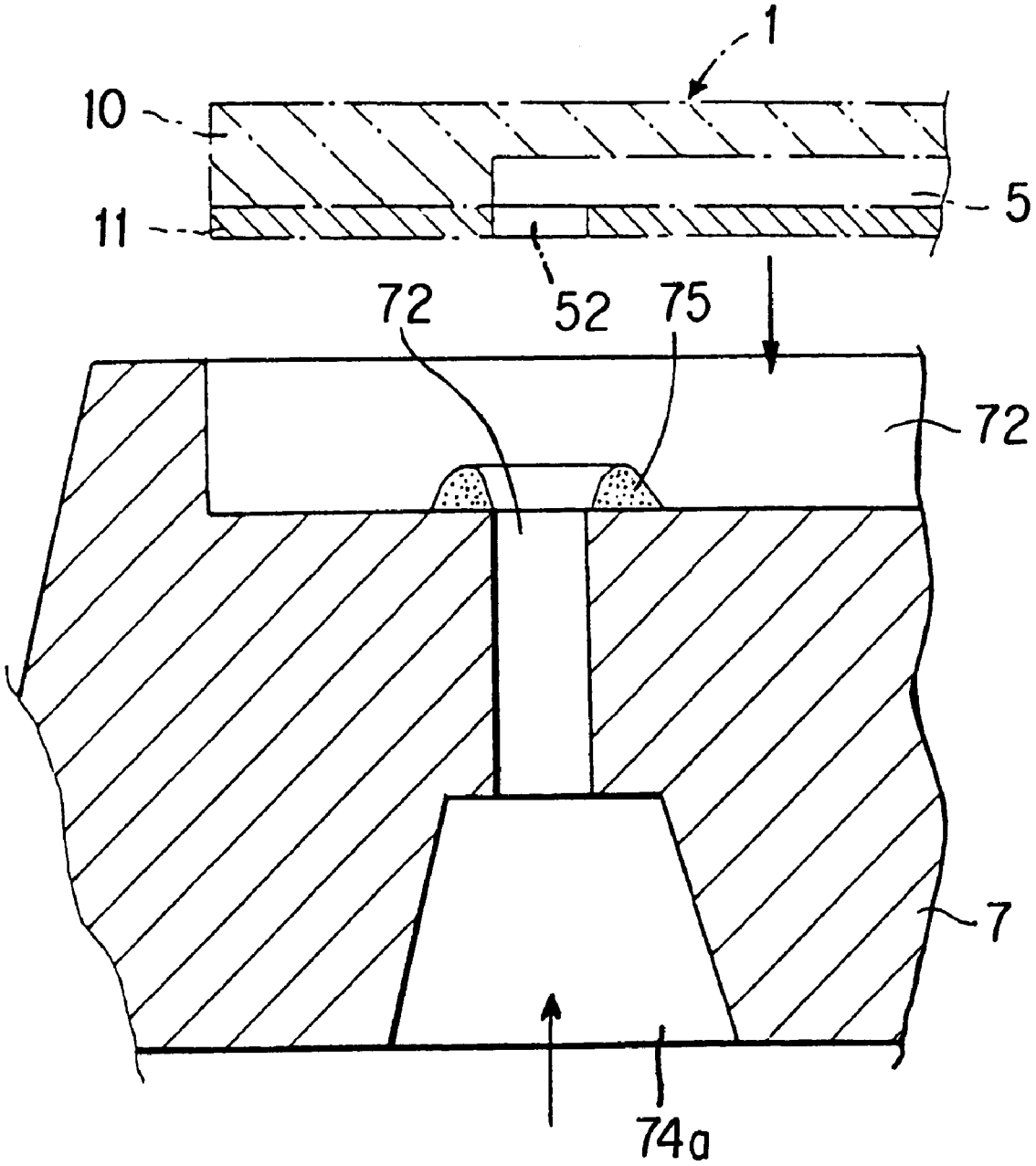
FIG. 14 is an enlarged fragmentary sectional view taken along lines X8—X8 in FIG. 13.
Figure 15:
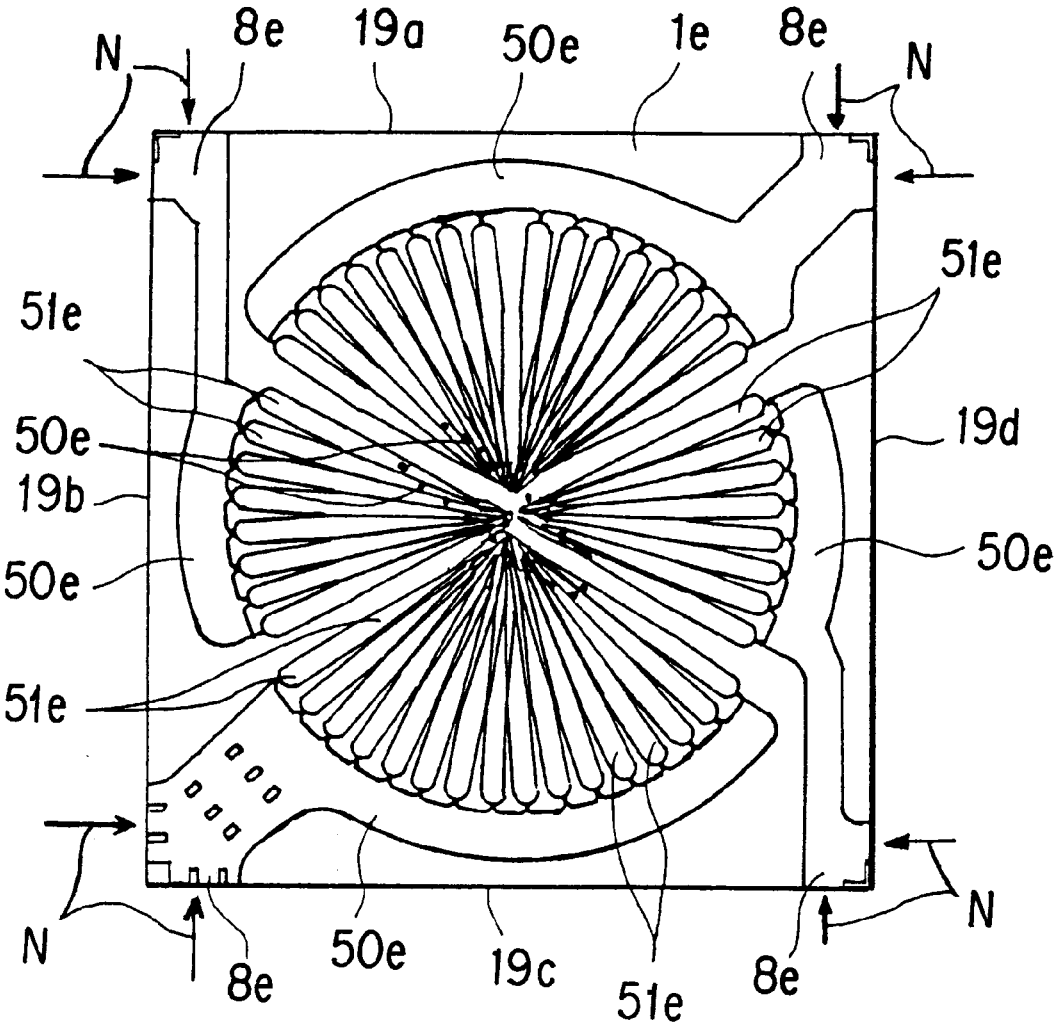
FIG. 15 PRIOR ART
FIG. 15 is a front view showing an example of prior art ink jet printhead.
Figure 16:
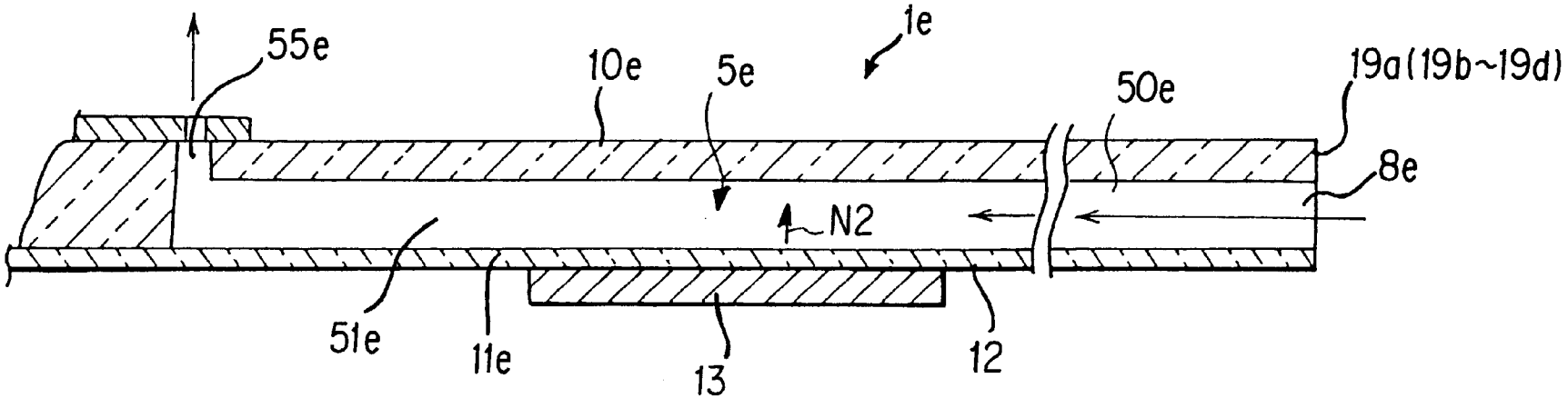
FIG. 16 PRIOR ART
FIG. 16 is an enlarged sectional view showing a principal portion of the prior art ink jet printhead.

As shown in FIG. 14, each of the ink supply ports 74 is surrounded by an annular seal 75 within the first recess 72. The seal 75, which is formed by directly applying silicone rubber to the front wall 7*a* of the case member 7, is elastically compressible under pressure. It should be appreciated that the seal 75 may be provided around each of the ink inlet ports 52 of the head body 1 which faces the ink supply port 74.

As shown in FIG. 13, the front wall 7*a* of the case member 7 is formed with a cutout 76 which is continuous with the first recess 72, and the cutout 76 is followed by a groove 76*a* formed on a side wall 7*b* of the case member 7. The series of the cutout 76 and the groove 76*a* is used for fitting and guiding the widened end 93 of the flexible cord 9A, as described hereinafter. Two other side walls 7*c*, 7*d* of the case member 7 are provided with a suitable number of engaging portions 77 which are in the form of slots or grooves.

The presser frame 6, which may be formed by press-working a thin metal plate for example, includes a frame body 60 which has a lower portion integrally formed with a total of four engaging pawls 61. The frame body 60 is configured to externally fit to a front portion of the case member and has a front surface portion formed with a window opening 62 defined by an inwardly directed flange 63. The inwardly directed flange 63 is designed to come into contact with a peripheral portion of the head body 1.

Each of the engaging pawls 61 has a hooked tip portion 61*a* which fits in the corresponding engaging portion 77 of the case member 7 for engagement therewith when the frame body 60 is externally fitted to the front portion of the case member 7. The engaging pawl 61 is elastically deformable outwardly in its thickness direction (in the direction of arrow N1).

In assembly, the cushion member 83A is first fitted in the second recess 73 of the front wall 7*a* of the case member 7. Then, the flexible cord 9A and the head body 1 are placed on the front wall 7*a* of the case member 7 over the cushion member. At this time, the head body 1 need only be arranged in the first recess 72 of the case member 7 to thereby position the head body 1 accurately for bring the ink inlet ports 52 of the head body 1 into conformity with the respective ink supply ports 74 of the case member 7.

Thereafter, the presser frame 6 is fitted onto the front portion of the case member 7 to cover the head body 1. At this time, the inward flange 63 of the presser frame 6 presses the peripheral portion of the head body 1 against the case member 7. Further, upon sufficient pressing of the presser frame 6 onto the case member 7, the hooked tip portions 61*a* of the engaging pawls 61 of the presser frame 6 come into engagement with the respective engaging portions 77 of the case member 7. Specifically, when the presser frame 6 is pressed onto the case member 7, the engaging pawls 61 are elastically opened. The hooked tip portions 61*a* automatically snap into the respective engaging portions 77 under the elastic force of the engaging pawls 61 when the hooked tip portions 61*a* reach the engaging portions 77. Therefore, the frame body 60 of the presser frame 6 need simply be pressed onto the case member 7 for attaching the presser frame 6 to the case member 7.

With the structure described above, not only the presser frame 6 is fixed to the case member 7, but also the head body 1 can be fixed to the front wall 7*a* of the case member 7 under pressure due to the provision of the presser member 6. Therefore, it is unnecessary to use an adhesive for attaching the head body 1 to the case member 7.

The rear surface of the head body 1 comes into contact with the seals 75 around the respective ink supply ports 74. These seals 75 are suitably held compressed for sealing the connection between ink inlet ports 52 of the head body 1 and the ink supply ports 74 of the case member 7, thereby preventing ink leakage. As a result, the ink flowing out from the ink outlet ports of the ink cartridge 3 can be properly guided into the ink passages 5 of the head body 1 to discharging through desired discharge ports 6 as ink droplets. Since the nozzle ports 55 face the window opening 62 of the presser frame 6, the presser frame 6 does not hinder discharing of the ink droplets.

Further, since the head body 1 is pressed by the presser frame 6, the flexible cord 9A interposed between the head body 1 and the cushion member 83A is held pressed against the piezoelectric elements 13 on the rear surface of the head body 1. Therefore, it is possible to maintain the flexible cord 9A in good electrical conduction with the piezoelectric elements 13 on the rear surface of the head body 1.

Figure 12:
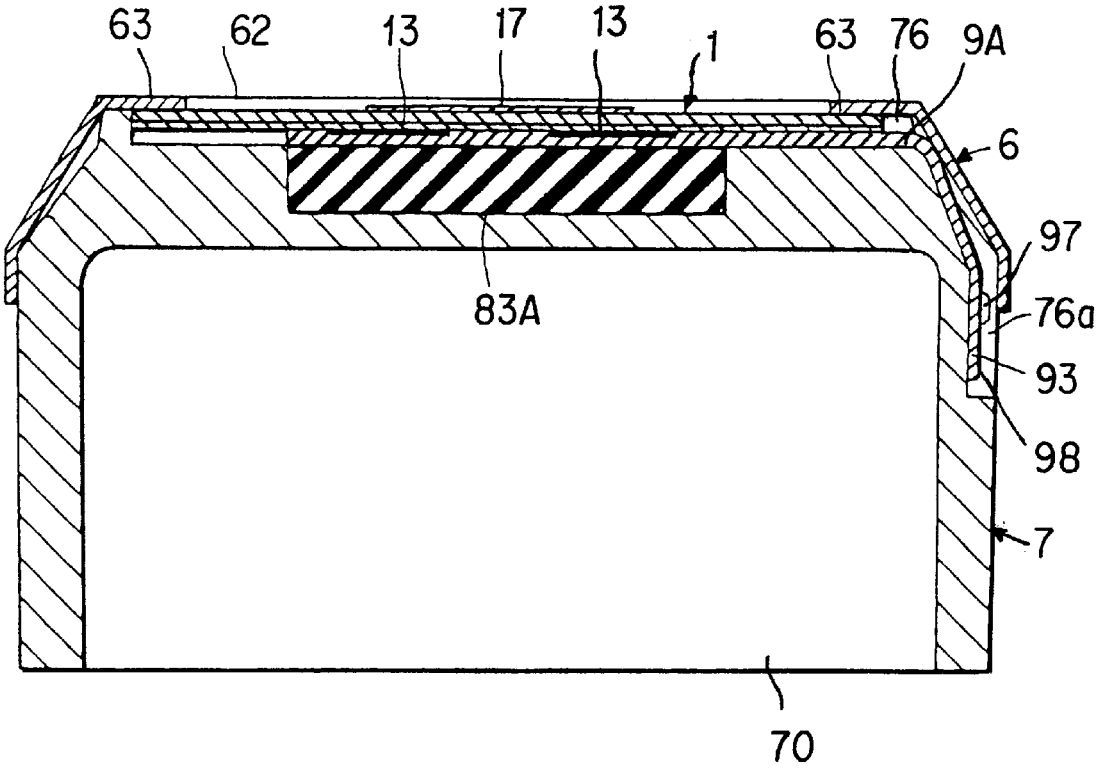
FIG. 12 is an enlarged sectional view taken along lines X7—X7 in FIG. 10.

Further, as shown in FIG. 12, since a part of the flexible cord 9A is fitted in the cutout 76 and groove 76*a* of the case member 7, the flexible cord 9A does not pose any hinderance in mounting the presser frame 6 to the case member 7.

According to the second embodiment, again, since the widened end 93 of the flexible cord 9A which carries the driver IC 97 and the terminals for the driver IC 97 is disposed on a side surface of the case member, the overall length of the flexible cord 9A can be reduced. Further, the external dimensions of the case member 7 may be reduced to realize a size reduction of the ink jet printhead as a whole.

While the ink jet printhead of the second embodiment is designed to perform color printing with inks of four colors, the present invention is not limited to such a design. The present invention is also applicable to an ink jet printhead which performs color printing with inks of three colors other than black or which performs monochrome printing only with an ink of a single color such as black.

According to the second embodiment, mounting of the presser frame 6 relative to the case member 7 is facilitated by the engaging pawls 61 provided on the presser frame 6. However, the present invention is not limited to such a structure. For instance, the presser frame may be mounted to the case member by other means such as screwing. In the case of using the engaging pawls 61, the engaging portions 77 provided on the case member 7 may, of course, take the form of projections.

According to the second embodiment, the case member 7 is designed to accommodates the ink cartridge 5. However, the case member may be designed not to accommodate any ink cartridge.

We claim:

1. An inkjet printhead comprising:

a head body including a passage forming panel and a vibration plate, the passage forming panel having a first surface formed with a plurality of grooved ink passages and a second surface formed with a corresponding number of discharge ports each communicating with a respective one of the grooved ink passages, the vibration plate being laminated on the first surface of the passage forming panel, the head body being also provided with a plurality of ink inlet ports in communication with the grooved ink passages for introducing ink into the grooved ink passages;

a plurality of piezoelectric elements attached to the vibration plate;

a driver IC electrically connected to the piezoelectric elements for controlling the piezoelectric elements; and a case member including a front portion for supporting the head body and outer surface portion formed with an inclined groove;

wherein the driver IC is arranged within the inclined groove of the outer surface portion of the case member in a manner such that the driver IC does not project out of the inclined groove.

2. The ink jet printhead according to claim 1, wherein each of the grooved ink passages includes a common ink passage communicating with a respective one of the ink inlet ports, and a plurality of individual ink passages each having one end connected to said each of the common ink passages, said each individual ink passage also having an opposite end being connected to a respective one of the discharge ports.

3. The ink jet printhead according to claim 1, further comprising at least one ink cartridge having an ink outlet port which faces a respective one of the ink inlet ports in communication therewith, the case member being arranged to house the ink cartridge therein and formed with through-holes each arranged in facing relation to a respective one of the ink inlet ports of the head body.

4. The ink jet printhead according to claim 3, further comprising a front frame mounted onto the case member, the front frame having ink supply ports each establishing mutual communication between said respective one of the ink inlet ports and the ink outlet port, each of the ink supply ports of the front frame being provided with a filter for ink filtration.

5. The ink jet printhead according to claim 4, further comprising tubular seals made of an elastic member interposed between the front frame and ink cartridge, the ink outlet port of the ink cartridge being held in communication with one of the ink supply ports of the front frame by one of the tubular seals.

6. The inkjet printhead according to claim 1, further comprising a presser frame for pressing the head body against the front portion of the case member, and a fixing means for fixing the presser frame to the case member.

7. The ink jet printhead according to claim 6, wherein the case member has side surfaces formed with engaging portions, the fixing means comprising engaging pawls provided on the presser frame for engagement with the engaging portions.

8. The ink jet printhead according to claim 3, further comprising annular elastic seals, each of the ink inlet ports and one of the through-holes of the case member being arranged to communicate with each other by one of the annular elastic seals.

9. The ink jet printhead according to claim 3, wherein the ink cartridge is releasably attached to the case member.

10. The ink jet printhead according to claim 1, further comprising a flexible cord for electrically connecting the piezoelectric elements to the driver IC, the driver IC being connected to one end of the flexible cord.

11. The ink jet printhead according to claim 10, further comprising a gap formed between the head body and the case member for taking out a part of the flexible cord onto said outer surface portion of the case member.

12. The ink jet printhead according to claim 10, wherein the driver IC is directly mounted on said one end of the flexible cord.

13. The ink jet printhead according to claim 10, wherein said one end of the flexible cord is provided with terminals for connecting the driver IC to an external printhead control device.

14. The ink jet printhead according to claim 10, further comprising a wiring member provided with terminals for connecting the driver IC to an external printhead control device, said one end of the flexible cord being connected to the wiring member.

15. The ink jet printhead according to claim 10, further comprising a reinforcing plate of a hard material fixed to said one end of the flexible cord.

16. The ink jet printhead according to claim 1, wherein the driver IC is coated with a hard resin.

17. The ink jet printhead according to claim 1, wherein the front portion of the case member is formed with a recess for positioning the head body relative to the case member when the head body is fitted.

* * * * *